US005951376A

United States Patent [19]

Mandler

[11] Patent Number: 5,951,376

[45] Date of Patent: Sep. 14, 1999

[54] PROCEDURE OF AND DEVICE FOR PROCESSING OPTICAL LENSES

[75] Inventor: Roland Mandler, Heuchelheim, Germany

[73] Assignee: Opto Tech GmbH, Wettenberg, Germany

[21] Appl. No.: 09/047,516

[22] Filed: Mar. 25, 1998

[30] Foreign Application Priority Data

Mar. 26, 1997 [EP] European Pat. Off. ..... 97105089

[51] Int. Cl.[6] ..... B24B 7/30; B24B 9/00; B24B 41/00

[52] U.S. Cl. ..... 451/43; 451/42; 451/65; 451/178; 451/231; 451/362

[58] Field of Search ..... 451/5, 42, 43, 451/65, 178, 231, 362

[56] References Cited

U.S. PATENT DOCUMENTS

| | | | |
|---|---|---|---|
| 3,948,007 | 4/1976 | Feneberg et al. | 451/42 |
| 4,598,502 | 7/1986 | Lombard | 451/42 |
| 4,768,308 | 9/1988 | Atkinson, III et al. | 451/5 |
| 5,149,337 | 9/1992 | Watanabe | 451/43 |
| 5,205,076 | 4/1993 | Vernon et al. . | |
| 5,384,988 | 1/1995 | Hernandez | 451/42 |
| 5,410,843 | 5/1995 | Gottschald | 450/43 |
| 5,482,495 | 1/1996 | Mayahara et al. | 451/5 |
| 5,498,200 | 3/1996 | Werner | 451/460 |
| 5,562,527 | 10/1996 | Nauche | 451/9 |
| 5,577,950 | 11/1996 | Smith et al. | 451/42 |
| 5,803,793 | 9/1998 | Mizuno et al. | 451/5 |

FOREIGN PATENT DOCUMENTS 63-037309 2/1988 Japan .

*Primary Examiner*—David A. Scherbel
*Assistant Examiner*—Philip J. Hoffmann
*Attorney, Agent, or Firm*—Lowe Hauptman Gopstein Gilman & Berner

[57] ABSTRACT

For two-side processing of optical lenses, the invention provides that blanks to be used for each lens body (7) comprise a chucking extension (18) whereby a single machine is sufficient for implementing the procedure. In addition to workpiece spindles (1, 2) as well as tool spindles (4, 5) with coarse tools (8) and finishing tools (9), the machine also includes an unloading device (10) and a loading device (13) which in successive interacting operations take the lens body (7) when processed on one side and at the circumference from a chucking tool (12) of the tool spindle (1) and turn it round for centered insertion in its inverted position into a chucking tool (15) of the tool spindle (2) for processing on the other side. The workpiece spindles (1, 2) may be mounted parallel to each other on a horizontally displaceable and vertically adjustable feed slide (3). A feed carriage (6) may displace and slew the tool spindles (4, 5) together with the unloading device (10) around a horizontal B axis. The loading device (13) is slewable around a further horizontal axis (C) between the workpiece spindles (1, 2) and the tool spindles (4, 5).

12 Claims, 6 Drawing Sheets

PROCEDURE OF AND DEVICE FOR PROCESSING OPTICAL LENSES

TECHNICAL FIELD

The present invention relates to a procedure of processing optical lenses and to an apparatus for implementing such a process.

BACKGROUND ART

For the fabrication of lenses, hot-pressed glass blanks are normally processed. Such blanks have a shape of flat cylinder disks, or have faces which may be curved, depending on the desired shape for the lens to be produced. In the prior art, the glass blanks are first given the desired contour by means of grinding machines. A first device coarse-grinds the lens blank on one side and provides the blank with a polishable finishing surface in a second operation. The lens is then removed from the first device, turned around, and is also coarse-ground and precision-ground on the other side thereof by a second grinding machine. Then the lens is polished on both sides thereof in a third device. Finally, the rim of the thus polished lens is processed in a fourth device, a so-called centering machine.

The lens rim is provided with a precise circular geometry, possibly also with chamfers at the edges so as to give them a better shock resistance. During the centering operation, the lens is held between metal centering bells which align the lens so that its optical axis coincides with the rotating axis of the centering spindle. With unfavorable lens shapes, however, when there is no self-centering effect of the centering bells, the lenses have to be centered in a separate centering device by means of a light ray before they are cemented to a centering spindle, set into rotation by means of this spindle and ground at their outer rim in order that the optical axis of the lens coincides with its geometrical axis.

A disadvantage of the procedure employed by the prior art for manufacturing lenses is that two grinding machines and a centering machine are required, in addition to the polishing machine. This represents the most modem known technology and under the further assumption that coarse grinding and precision grinding of each side of the lens is already done in a single device. Nevertheless, a large amount of machinery is involved. Another disadvantage of the prior art is that by means of the metal tools used therein, e.g., the above noted centering bells, the polished lenses are chucked in the centering machine at their delicate polished surfaces, which thus may be easily damaged.

Moreover, it is disadvantageous that with the conventional procedure described above, each lens is chucked at its circumference which has only the quality and precision of a glass blank. When the first lens side has been finished, the lens is turned about as hereinabove described and rechucked in a second device. During this rechucking and centering at the still little precise circumference of the lens, undesirable inaccuracies and differences between the optical axes of the two lens sides may occur.

It is an important object of the present invention to manufacture lenses more cheaply and, at the same time, to increase the processing accuracy. Additionally, the proposed procedure and the device for its implementation aim at simplifying coarse grinding and precision grinding of the two lens sides as well as simplifying centering operations.

DISCLOSURE OF THE INVENTION

The present invention aims at overcoming these and other drawbacks of the prior art.

In accordance with the invention, in a method of processing optical lenses where a blank of a lens body is chucked and provided with a predefined contour by coarse and finishing tools through grinding and polishing operations, a lens body is provided with a chucking extension which permits and requires that only a single chucking operation be performed on the blank, the chucking extension being removed at the end of the process.

The inventive method is thus based on a novel geometry of the lens blank, of which a normal hot-pressed glass body will do whose shape can be varied with certain limits without the necessity of incurring appreciable extra cost. The new shape of the lens body differs from the previous standard shapes of lens blanks by including a chucking extension of, for example, a few millimeters height on one side of the lens body, which is thus set off to be noticeably smaller in diameter than the overall outer diameter of the lens body.

This basic shaping of the lens body makes it possible to carry out the aspects of the invention wherein coarse and precision processing of one side of the lens body is performed in one and the same chucking of the extension, whereupon the chucked lens body is turned around and processed on the back in the same single chucking position. During these operations, the optical axis of the lens and its geometrical axis will coincide substantially perfectly, as the lens body is chucked only once. Subsequent centering of the lens in a special centering machine is thus unnecessary since the lens is already centered when it leaves the first processing step.

In accordance with another aspect of the invention, the removal from a first chucking device and the insertion into a second chucking device are performed in a single intermediate stalling and inverting operation. Advantageously, this feature of the invention not only saves considerable auxiliary machinery, but also contributes substantially to the precision of lens processing.

According to another feature of the invention, it is further possible with this method to process the rim of the lens body during each chucking operation. In particular, according to another feature, the lens body circumference is processed for subsequent centering in a first chucking position. Therefore, the lens body will be rechucked at its already processed and thus very precise circumference, and consequently may be accurately aligned to the rotation axis of the workpiece spindle. It is thus ensured that during subsequent coarse grinding and precision grinding of the second lens side, the optical axis of this lens surface will again coincide exactly with its geometrical axis.

In a specific embodiment of the invention, controlled movements of the workpiece and the tools towards and away from each other are performed in a single machine in such a way that each side of the lens body is processed first on its face and subsequently on its circumference. According to another feature, a partly processed or finished lens body may be provided with an edge chamfer on at least one side in order to protect the edge, or each edge, of the lens body, respectively.

According to another aspect of the invention, a device for processing optical lenses according to the invention is distinguished by the following features:

a) a machine column is provided with motor drives and guiding means for two vertically displaceable workpiece spindles for a blank of a lens body to be received by them for processing;

b) two tool spindles that are horizontally displaceable in an X axis direction and are slewable at a right angle thereto around a horizontal slewing axis B are associated to the workpiece spindles in variable opposite arrangement;

c) an unloading device that is displaceable perpendicularly to the horizontal slewing axis B is arranged between the tool spindles, and d) a loading device slewable around a further slewing axis C is associated to the unloading device.

It will be appreciated that such a device designed in accordance with the invention permits complete processing, so that only this single machine will be required for coarse grinding and precision grinding of both lens sides, as well as for centering and application of chamfers.

According to another aspect of the invention, the device is preferably designed in such a manner that the slewing axes are parallel to each other and are substantially at right angles to the X axis, whereby a very compact structure is achieved.

According to yet another feature of the inventive apparatus, both workpiece spindles comprise chucking means for the lens body, and particularly may include collets that may be pneumatically or hydraulically operable. Moreover, in accordance with another aspect of the invention, the unloading device as well as the loading device may each comprise chucking means for the lens body and, in particular, may comprise suction chucks. These permit gentle seizing of the lens body so that the delicate lens surface will be protected during the reloading procedure.

In accordance with still a further aspect of the invention the workpiece spindles, on the one hand, and the tool spindles on the other hand, are each independently movable in the direction of a Z axis and the X axis, respectively, each of the tool spindles having an individual slewing B axis. With this embodiment, all four spindles are simultaneously in operation in order to process two lenses at the same time.

Alternatively, another feature of the invention provides that the workpiece spindles are mounted on a feed slide parallel to each other and perpendicularly to the main dimension of the slide. This will permit common movement and consequently saving of a drive. Similarly, according to yet another feature of the invention, the tool spindles may be mounted on a feed carriage located above the workpiece spindles, which carriage is slewable around the horizontal slewing B axis and holds the two tool spindles at a constant distance above the workpiece spindles. Another feature provides for the distance between the tool spindles to be equal to the distance between the workpiece spindles.

Also advantageous is the further development of the invention, whereby one tool spindle is equipped with a coarse-grinding tool and the other tool spindle is equipped with a precision-grinding tool. According to still another feature, each tool may have a face and a circumferential grinding surface, thus permitting production of the lens contour, processing the circumference in the following operations and—if desired—production of a chamfer for edge protection.

According to the invention, one and the same tool thus serves to implement the entire sequence of operations.

In accordance with a particularly advantageous combination of features, the invention includes:

a) a machine column with motor drives and guiding means for a feed slide and a feed carriage;

b) a feed slide which is vertically displaceable in a Z axis direction and which holds two workpiece spindles each carrying a chucking tool for a lens bland to be held thereby;

c) a feed carriage which is horizontally displaceable in an X axis direction as well as being slewable around a B axis running substantially at right angles to the main dimension of the feed carriage which supports two tool spindles;

d) the feed carriage holds an unloading device that is displaceable perpendicularly to the main feed carriage dimension;

e) a loading device that is slewable around a horizontal axis C which is arranged between the unloading device and the feed slide; and f) the tool spindles comprise a coarse-grinding and a precision-grinding tool each having a face grinding surface and a circumferential grinding surface.

The structure according to the invention may thus be designed as a fully automatic machine so that no manual intervention will be required as the lens body is processed from the blank to the finished contour. Essential quality features and advantages of the invention result from the fact that the optical axis of each lens side coincides with its geometrical axis so that the optical axes of both lens sides will also coincide.

Further features, details and advantages of the invention will become evident from the wording of the claims as well as from the following description of a preferred embodiment illustrated in the drawing which shows by way of 12 schematic side views the arrangement and use of the device of the invention, elucidating at the same time the sequence of operations of the procedure of the invention. The preferred embodiment of the invention is shown in the drawings simply by way of illustration and not of limitation thereof, showing one of the best modes (and alternative embodiments) suited to carry out the inventive concept.

The invention itself is set forth in the claims appended hereto. As will be realized upon examination of the specification and drawings and from practice of the same, the present invention is capable of still other, different, embodiments and its several details are capable of modifications in various obvious aspects, all without departing from the scope of the invention as recited in the claims. Accordingly, the drawings and the descriptions provided herein are to be regarded as illustrative in nature and not as restrictive of the invention.

BRIEF DESCRIPTION OF THE DRAWING

The accompanying drawings, incorporated into and forming a part of the specification, illustrate several aspects of a preferred embodiment of the present invention and, together with the description, serve to explain the principles of the invention. In the drawings.

BEST MODE FOR CARRYING OUT THE INVENTION

Figure 2:
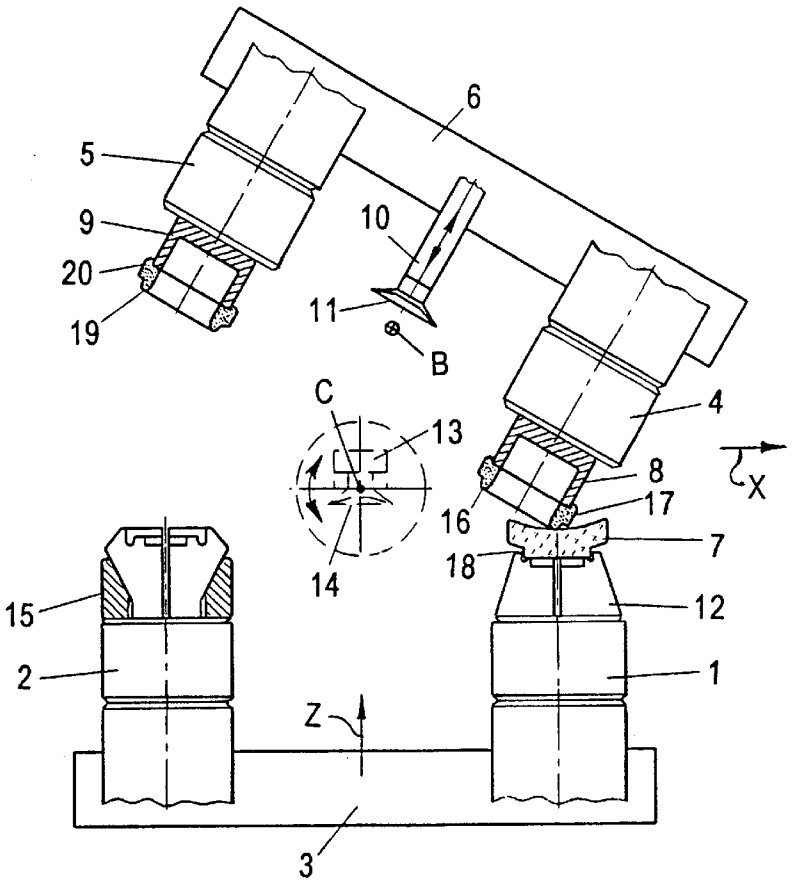
FIGS. 1–5 provide a view of an apparatus according to the invention while performing various steps of the inventive process on one side of a lens body.
Figure 1:
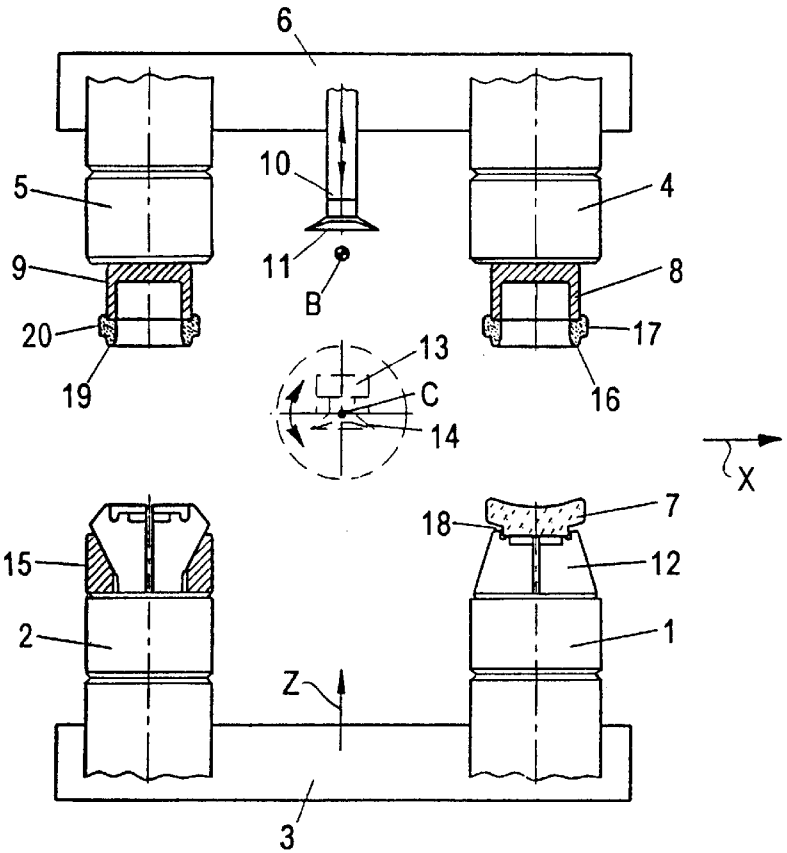
Figure 4:
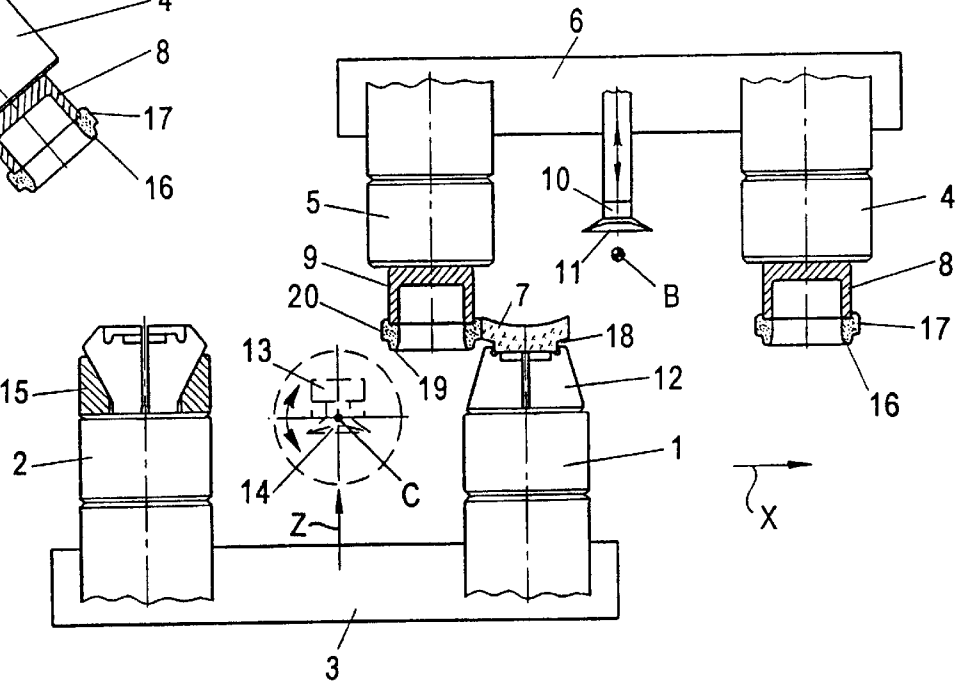
Figure 3:
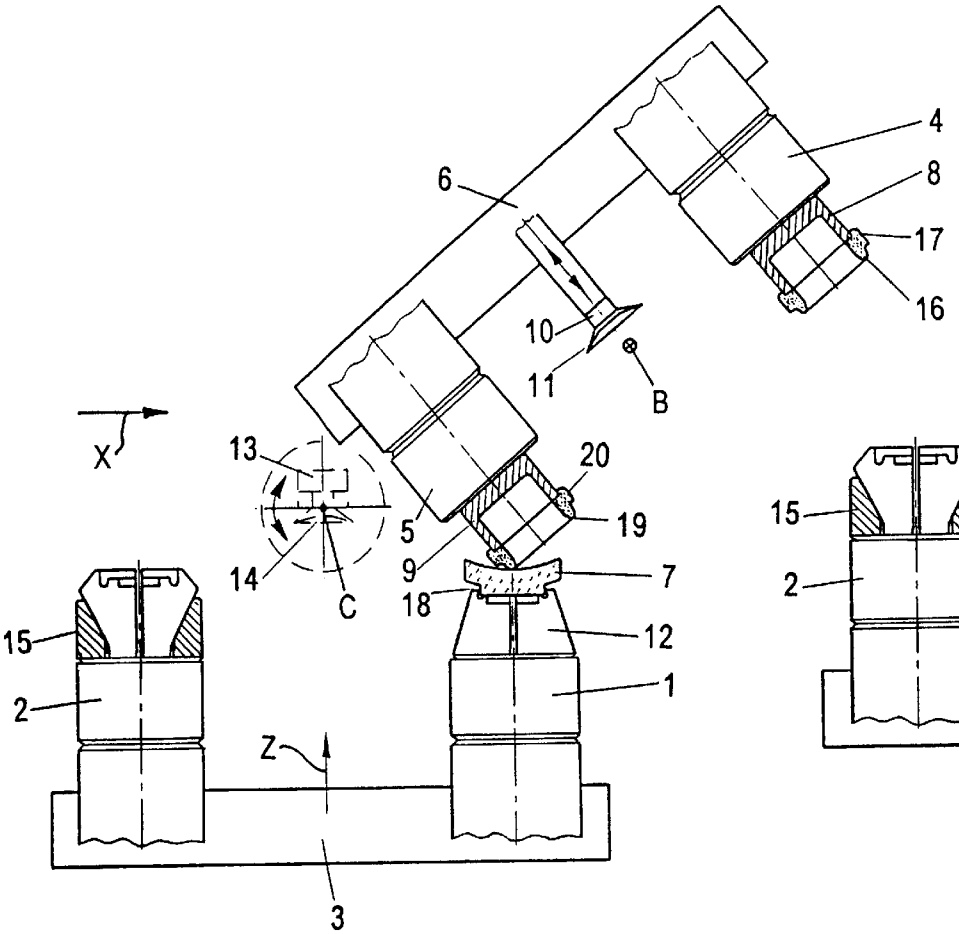
Figure 6:
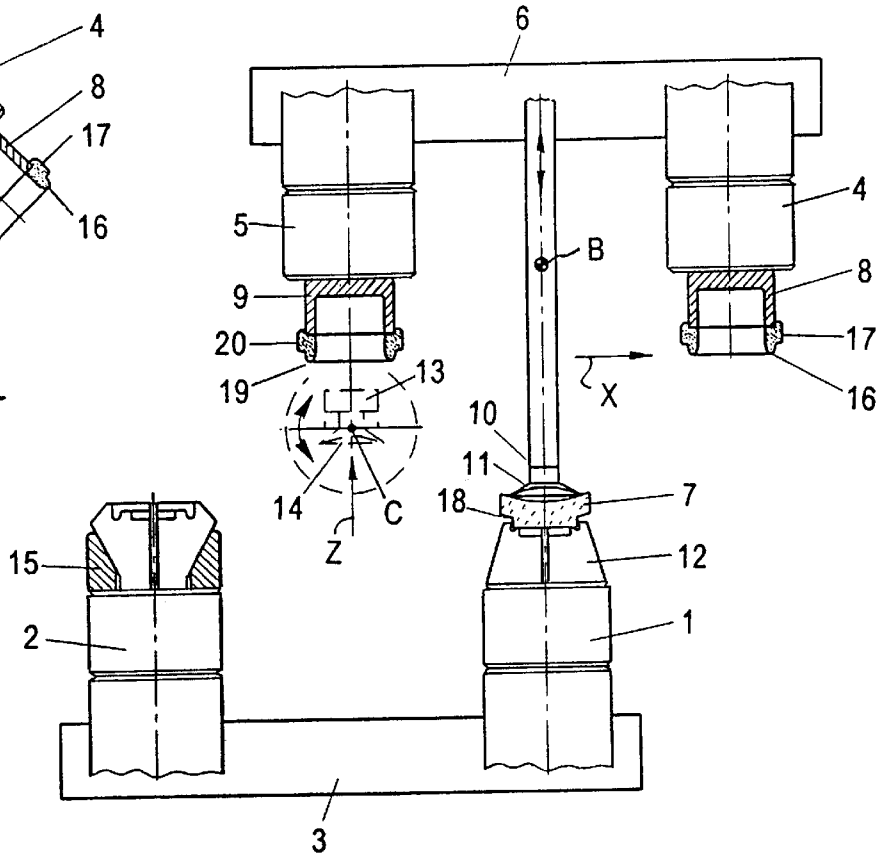
FIGS. 6–8 show the inventive apparatus while implementing steps of transitioning the blank of the lens body to permit additional steps to be performed on the other side of the lens body.
Figure 5:
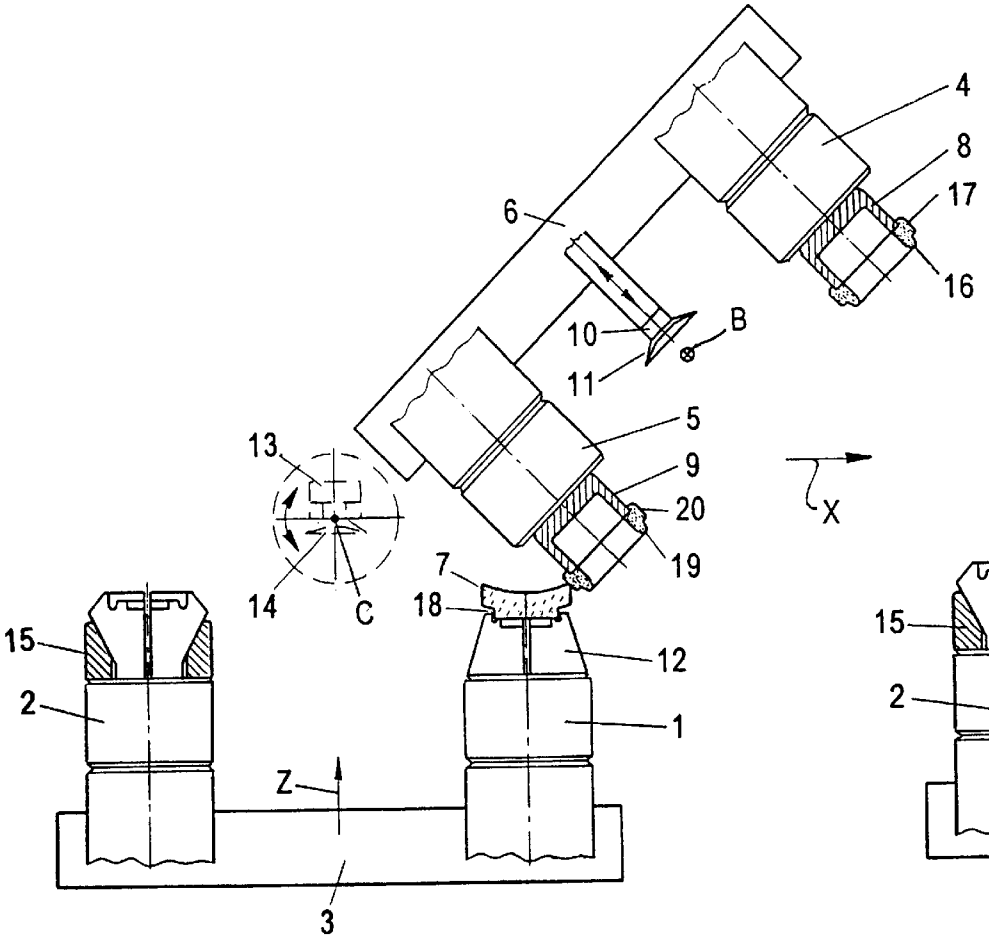
Figure 8:
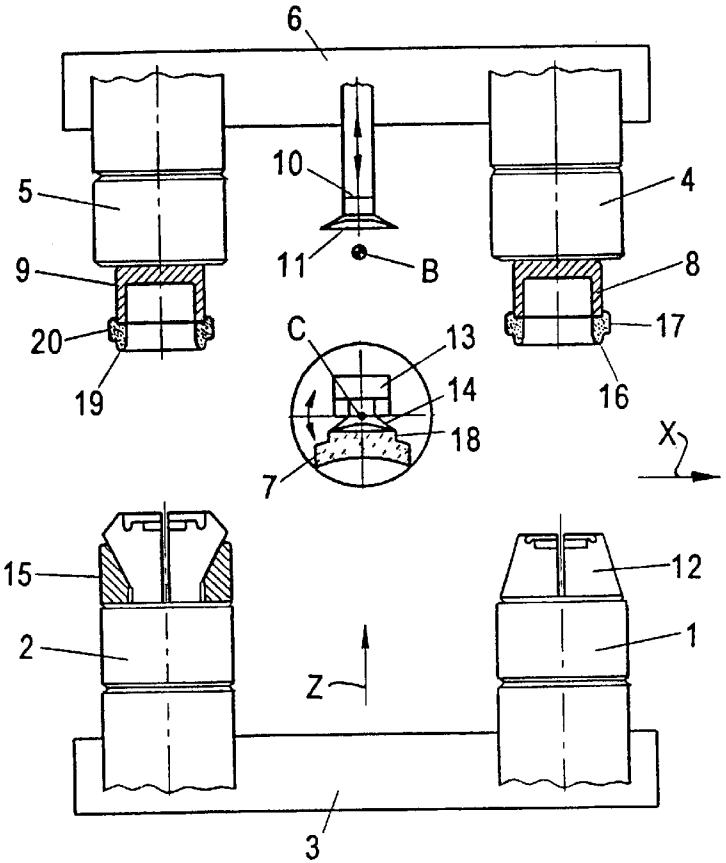
Figure 7:
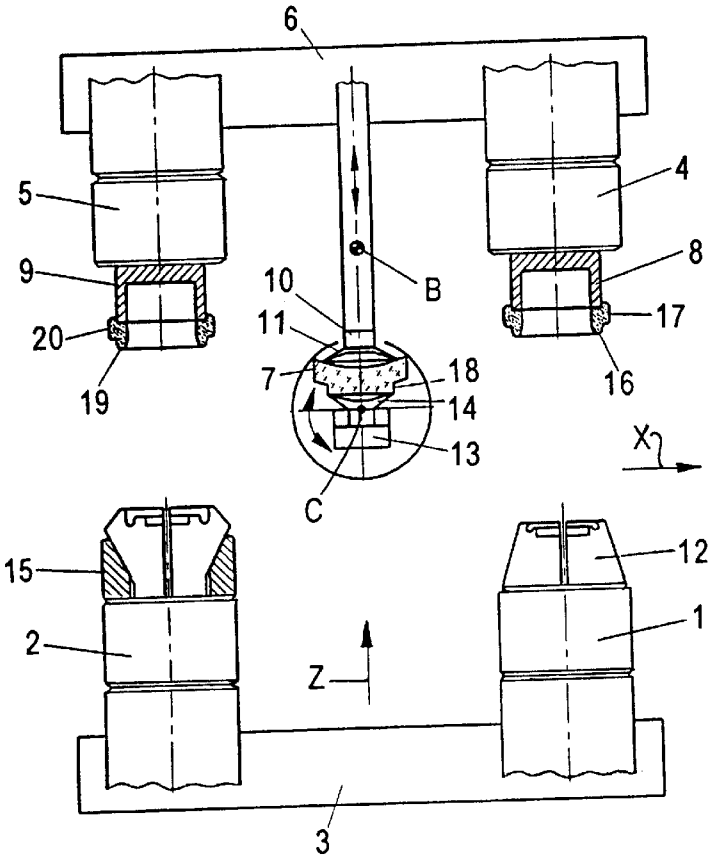
Figure 10:
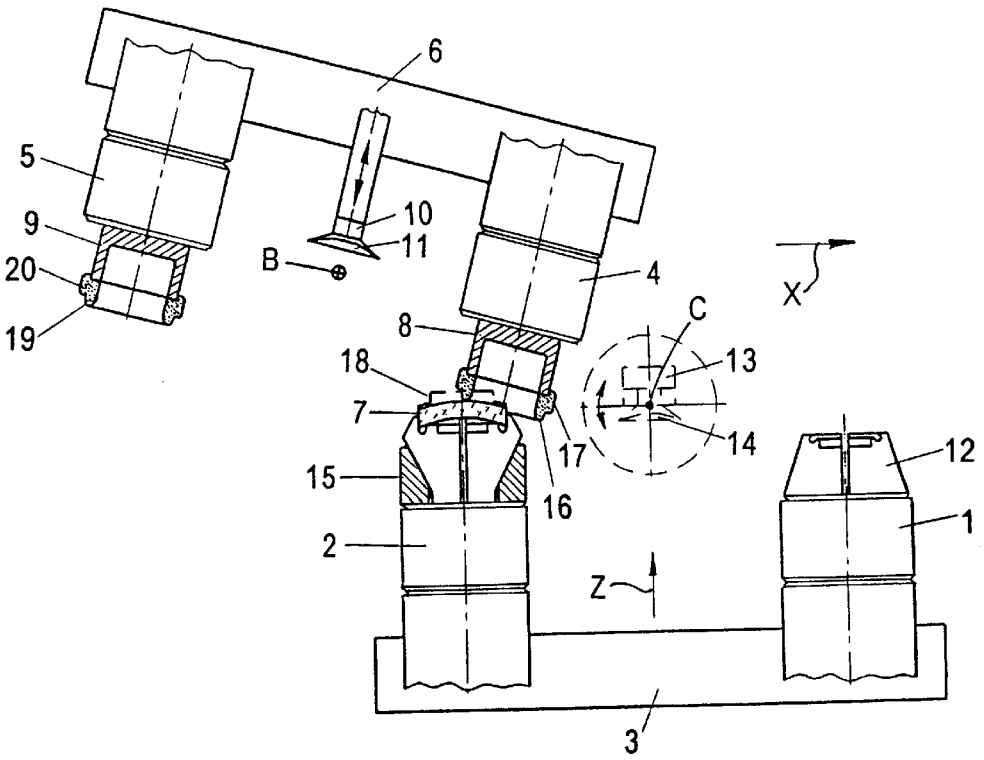
FIGS. 9–12 illustrate the inventive apparatus while implementing the additional steps on the other side of the lens body, including removal of the chucking extension therefrom.
Figure 9:
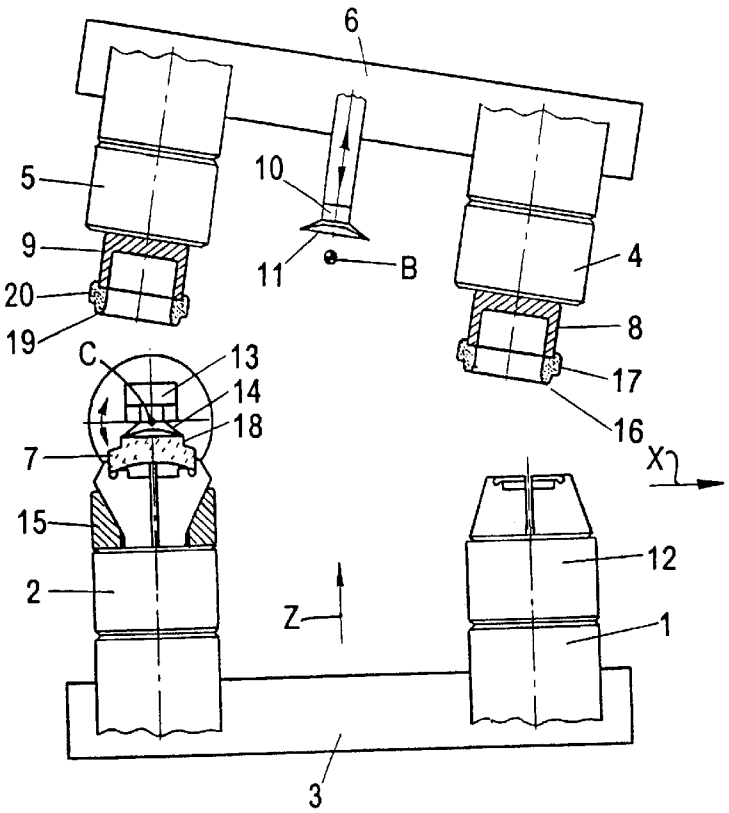
Figure 12:
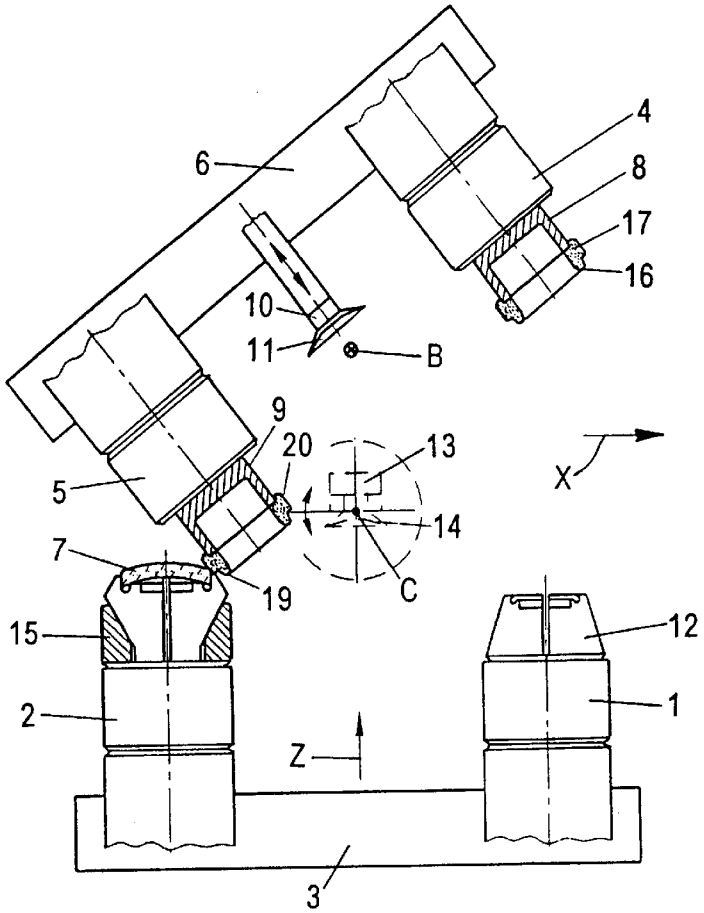
Figure 11:
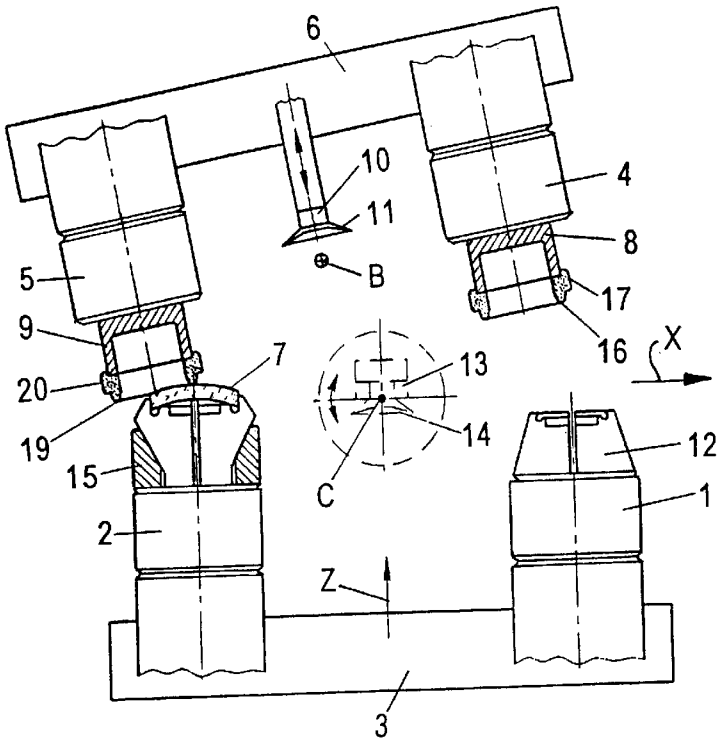

Referring now to the drawings, in the device shown, two workpiece spindles 1 and 2 are fastened to a common feed slide 3 that permits simultaneous movement of the two workpiece spindles 1 and 2 in a vertical direction or Z axis.

Two tool spindles 4 and 5 are fastened in a corresponding arrangement, preferably on a common feed carriage 6 that permits simultaneous horizontal movement (in the X axis direction). The feed carriage 6 and the connected tool spindles 4 and 5 have a common B axis around which the feed carriage 6 together with the tool spindles 4 and 5 can be slewed in either rotational direction.

In a modified device not described in detail herein, it is also possible that the workpiece spindles 1 and 2 are guided by separate feeding devices, whereby they can be moved in the direction of the Z axis independently of each other. The same applies to the tool spindles 4 and 5, which may also be guided by separate feeding devices and consequently mal be moved in the direction of the X axis independently of each other. A separate B axis that is perpendicular to the X axis may also be provided for each of the tool spindles 4 and 5 so that each of these spindles may be slewed separately around a B axis.

I claim:

1. Apparatus for processing optical lenses with only a single chucking operation on a blank of a lens body having a chucking extension, comprising:

a) a machine column having motor drives and guiding means for two vertically displaceable workpiece spindles for receiving said blank for processing;

b) two tool spindles horizontally displaceable along an X axis and slewable at a right angle thereto around a horizontal slewing axis (B), said tool spindles associated to said workpiece spindles in a variable opposite arrangement;

c) unloading means displaceable perpendicularly to said horizontal slewing axis (B), said unloading means arranged between said tool spindles; and d) loading means slewable around a further slewing axis (C) and associated to said unloading means.

2. Apparatus according to claim 1, wherein said slewing axes are substantially parallel to each other and are substantially at right angles to the direction of the X axis.

3. Apparatus according to claim 1, wherein said workpiece spindles include chucking means for said lens body, said chucking means comprising collets operable by fluid pressure.

4. Apparatus according to claim 1, wherein each of said unloading means and said loading means has chucking means for said lens body, said chucking means comprising suction chucks.

5. Apparatus according to claim 1, wherein said workpiece spindles and said tool spindles are displaceable independently of each other, in a direction of a Z axis and in a direction of the X axis, and wherein each of the tool spindles has an individual slewing axis (B).

6. Apparatus according to claim 1, wherein said workpiece spindles are mounted on a feed slide substantially parallel to each other and substantially perpendicularly to the main dimension of said feed slide.

7. Apparatus according to claim 6, wherein the distance between said tool spindles is substantially equal to the distance between said workpiece spindles.

8. Apparatus according to claim 1, wherein said tool spindles are mounted on a feed carriage located above said workpiece spindles and slewable around said horizontal slewing axis (B).

9. Apparatus according to claim 8, wherein the distance between said tool spindles is substantially equal to the distance between said workpiece spindles.

10. Apparatus according to claim 1, wherein one of said two tool spindles is equipped with a coarse-grinding tool and the other of said two tool spindles is equipped with a precision-grinding tool.

11. Apparatus according to claim 10, wherein each of said coarse-grinding tool and said precision-grinding tool has a face grinding surface and a circumferential grinding surface.

12. Apparatus for processing optical lenses with only a single chucking operation on a blank of a lens body having a chucking extension, comprising:

a) a machine column having motor drives and a guiding means for a feed slide and for a feed carriage;

b) wherein said feed slide is vertically displaceable in a direction defined by a Z axis and holds two workpiece spindles, each said of said workpieces being provided with a respective chucking tool for said blank of a lens body to be received thereby;

c) said feed carriage being horizontally displaceable in a direction defined by an X axis and being slewable around a horizontal B axis running substantially at right angles to a main dimension of said feed carriage;

d) said feed carriage supporting two tool spindles;

e) said feed carriage holding an unloading device which is displaceable perpendicularly to said main dimension of said feed carriage;

f) loading means slewable around a horizontal axis (C) arranged between said unloading device and said feed slide;

g) said tool spindles comprising a coarse-grinding tool and a precision-grinding tool, each having a respective face grinding surface and a circumferential grinding surface.

* * * * *